US008459774B2

(12) United States Patent
Nishida

(10) Patent No.: US 8,459,774 B2
(45) Date of Patent: Jun. 11, 2013

(54) LIQUID JETTING APPARATUS

(75) Inventor: Katsunori Nishida, Aichi-ken (JP)

(73) Assignee: Brother Kogyo Kabushiki Kaisha, Nagoya-shi, Aichen-ken (JP)

( * ) Notice: Subject to any disclaimer, the term of this patent is extended or adjusted under 35 U.S.C. 154(b) by 270 days.

(21) Appl. No.: 12/868,169

(22) Filed: Aug. 25, 2010

(65) Prior Publication Data

US 2011/0050796 A1 Mar. 3, 2011

(30) Foreign Application Priority Data

Aug. 31, 2009 (JP) ..... 2009-200947

(51) Int. Cl.
*B41J 2/165* (2006.01)

(52) U.S. Cl.
USPC ..... 347/29

(58) Field of Classification Search
USPC ..... 347/29
See application file for complete search history.

(56) References Cited

U.S. PATENT DOCUMENTS

| | | | |
|---|---|---|---|
| 6,142,600 | A | 11/2000 | Takahashi et al. |
| 2009/0079788 | A1 | 3/2009 | Hosono et al. |

FOREIGN PATENT DOCUMENTS

| | | |
|---|---|---|
| JP | 10-6527 | 1/1998 |
| JP | 2002-240320 | 8/2002 |
| JP | 2009-73076 | 4/2009 |

*Primary Examiner* — Kevin S Wood
(74) *Attorney, Agent, or Firm* — Scully, Scott, Murphy & Presser, PC

(57) ABSTRACT

There is provided a liquid jetting apparatus including: a first and a second cartridge attaching section; a liquid jetting head on which a plurality of first nozzles and a plurality of second nozzles are formed and which has a plurality of driving sections provided corresponding to the nozzles respectively; and a flushing control unit which operates the driving sections to cause execution of a first flushing operation in which an amount of the liquid forcibly jetted from the first nozzles is made smaller than an amount of the liquid forcibly jetted from the second nozzles when a height of the first cartridge is greater than a height of the second cartridge.

14 Claims, 7 Drawing Sheets

LIQUID JETTING APPARATUS

CROSS REFERENCE TO RELATED APPLICATION

The present application claims priority from Japanese Patent Application No. 2009-200947, filed on Aug. 31, 2009, the disclosure of which is incorporated herein by reference in its entirety.

BACKGROUND OF THE INVENTION

1. Field of the Invention

The present invention relates to a liquid jetting apparatus forcibly discharging a liquid which has flowed back into a liquid jetting head.

2. Description of the Related Art

As an example of a conventional liquid jetting apparatus, an ink jetting apparatus such as an ink-jet printer is known. A common ink jetting apparatus includes an ink-jet head having a plurality of nozzles jetting inks and a plurality of driving parts corresponding to the nozzles, and at the time of printing, in response to the selective operation of each of the driving parts, the ink is jetted from a corresponding one of the nozzles toward a paper. Further, at the time of maintenance, after a nozzle cap is placed on a nozzle surface of the ink-jet head, a pump sucks air in the nozzle cap. Consequently, the inks with increased viscosities and bubbles in the ink-jet head are forcibly discharged into the nozzle cap.

A process of forcibly discharging the inks with increased viscosities and bubbles is generally called "purge". In the "purge" of a type using a vacuum pump for sucking, a magnitude of a negative pressure in the nozzle cap becomes higher than a magnitude of a negative pressure in the ink-jet head, so that the inks with increased viscosities and so on in the ink-jet head are forcibly discharged as described above. However, after the vacuum pump is stopped, since the pressure in the ink-jet head is kept at the negative pressure though the negative pressure in the nozzle cap is released, there is a risk that the inks in the nozzle cap may flow back toward the inside of the nozzles. Therefore, in an ink jetting apparatus capable of color printing and thus jetting a plurality of color inks, "color mixture" in the nozzles is likely to occur because the color inks mixed in the nozzle cap may flow back toward the nozzles. When the mixed color ink is jetted at the time of the printing, printing quality is greatly impaired.

Therefore, it is a conventional practice that a forced ink jetting operation (that is, idle jetting operation) called "color mixture preventive flushing" by the driving parts is executed after the "purge", whereby the inks which have flowed back into the nozzles are discharged from the nozzles together with the inks that they should originally jet.

SUMMARY OF THE INVENTION

In recent years, in response to a user's need for a reduced trouble of replacing an ink cartridge and so on, there have been provided ink cartridges among which one ink cartridge for a specific color ink has a far larger initial capacity than initial capacities of ink cartridges for other color inks. Under such circumstances, there has been proposed an ink-jet printer in which an ink cartridge with a standard capacity and an ink cartridge with a large capacity can be selectively attached. In such an ink-jet printer, a specific color ink is supplied from the large-capacity ink cartridge and other color inks are supplied from the standard-capacity ink cartridges.

The present inventor has found out that, when the idle jetting for preventing the color mixture is performed under the same condition for a first color ink supplied from a large-capacity ink cartridge and a second color ink supplied from a standard-capacity ink cartridge, an amount of the first color ink jetted during the idle jetting becomes larger than an amount necessary for preventing the color mixture and thus the first color ink is wasted.

The present invention was made to solve the aforesaid problem found by the present inventor, and has an object to provide a liquid jetting apparatus in which, in an environment where a plurality of kinds of liquid cartridges with different initial capacities are used, an amount of a liquid jetted during the idle jetting for preventing color mixture can be decided properly for each of the liquid cartridges, enabling a reduction in the waste of the liquid.

According to an aspect of the present invention, there is provided a liquid jetting apparatus which jets a first liquid stored in a first liquid cartridge and a second liquid stored in a second liquid cartridge, including:

a first cartridge attaching section to which the first liquid cartridge is attached;

a second cartridge attaching section to which the second liquid cartridge is attached;

a liquid jetting head in which a plurality of nozzles are formed, the nozzles including a plurality of first nozzles and a plurality of second nozzles which communicate with the first and second liquid cartridges respectively under a condition that the first and second liquid cartridges are attached to the first and second cartridge attaching sections, the liquid jetting head having a plurality of driving sections provided corresponding to the nozzles to cause each of the nozzles to jet one of the first and second liquids; and a flushing control unit which controls the driving sections to perform a first flushing operation in which an amount of the first liquid forcibly jetted from the first nozzles is made smaller than an amount of the second liquid forcibly jetted from the second nozzles under a condition that a height of the first cartridge attached to the first cartridge attaching section is greater than a height of the second cartridge attached to the second cartridge attaching section.

As a result of studious studies, the present inventor has found out that a degree of backflow of a liquid in each nozzle varies depending on a level difference (head difference) between a liquid level of an ink cartridge communicating with the nozzle and a jetting port of the nozzle. It has been found out that the more lower the liquid level of the ink cartridge is than the height of the jetting port of the nozzle, the more a pressure acting on an ink located on an upstream side of the nozzle decreases and the larger the degree of the backflow is. That is, the more lower the liquid level of the ink cartridge is and the larger the head difference between the liquid level of the ink cartridge and the jetting port of the nozzle is, the more a negative pressure acting on the ink inside the nozzle increases and the larger the degree of the backflow of the ink toward the inside of the nozzle is.

Generally, the larger an outside height size of a liquid cartridge (hereinafter, simply referred to as the size of the liquid cartridge) is, the larger an initial capacity of the liquid cartridge is, while the smaller the size is, the smaller the initial capacity is. From this, it can be inferred that the size of the liquid cartridge is correlated with its initial capacity. In a liquid cartridge with a small initial capacity, a liquid level is relatively low and a degree of backflow of its liquid is large, and therefore, it is desirable that an amount of this liquid jetted while the idle jetting should be large. On the other hand, in a liquid cartridge with a large initial capacity, a liquid level is relatively high and a degree of backflow of its liquid is small, and therefore it is desirable that an amount of this liquid jetted while the idle jetting should be small. Therefore, when the size of the first liquid cartridge is larger than the size of the second liquid cartridge, assuming that the head difference between the liquid level of the first liquid cartridge and the jetting port of the nozzle is smaller than the head difference between the liquid level of the second liquid cartridge and the jetting port of the nozzle, an amount of the liquid jetted during the idle jetting for the first liquid cartridge whose liquid is thought to backflow to a smaller degree is made small.

According to the liquid jetting apparatus of the present invention, since an amount of the liquid jetted during the idle jetting is adjusted for each of the liquid cartridges based on the size (height size) of each of the liquid cartridges, the apparatus does not require a complicated detector for detecting the initial capacities and can be manufactured easily and at low cost. Further, as compared with an apparatus in which an amount of the liquid jetted during the idle jetting is adjusted according to the liquid level while monitoring a residual amount of the liquid in the cartridge, that is, while monitoring the liquid level at any time, its control is not complicated owing to no need for a structure monitoring the liquid level. Further, even in an environment where a plurality of kinds of liquid cartridges having different initial capacities are provided, an amount of the liquid jetted during the idle jetting can be properly adjusted for each of the liquid cartridges based on the size (that is, the initial capacity) of each of the liquid cartridges, which can reduce the waste of the liquid in the color mixture preventive flushing.

DETAILED DESCRIPTION OF THE PREFERRED EMBODIMENT

Hereinafter, a "liquid jetting apparatus" according to an embodiment of the present invention will be explained with reference to the drawings. In the following explanation, "under/down" means a direction in which an ink jetted from an ink-jet head moves toward a paper, and "above/up" means an opposite direction.

First Embodiment

Figure 1:
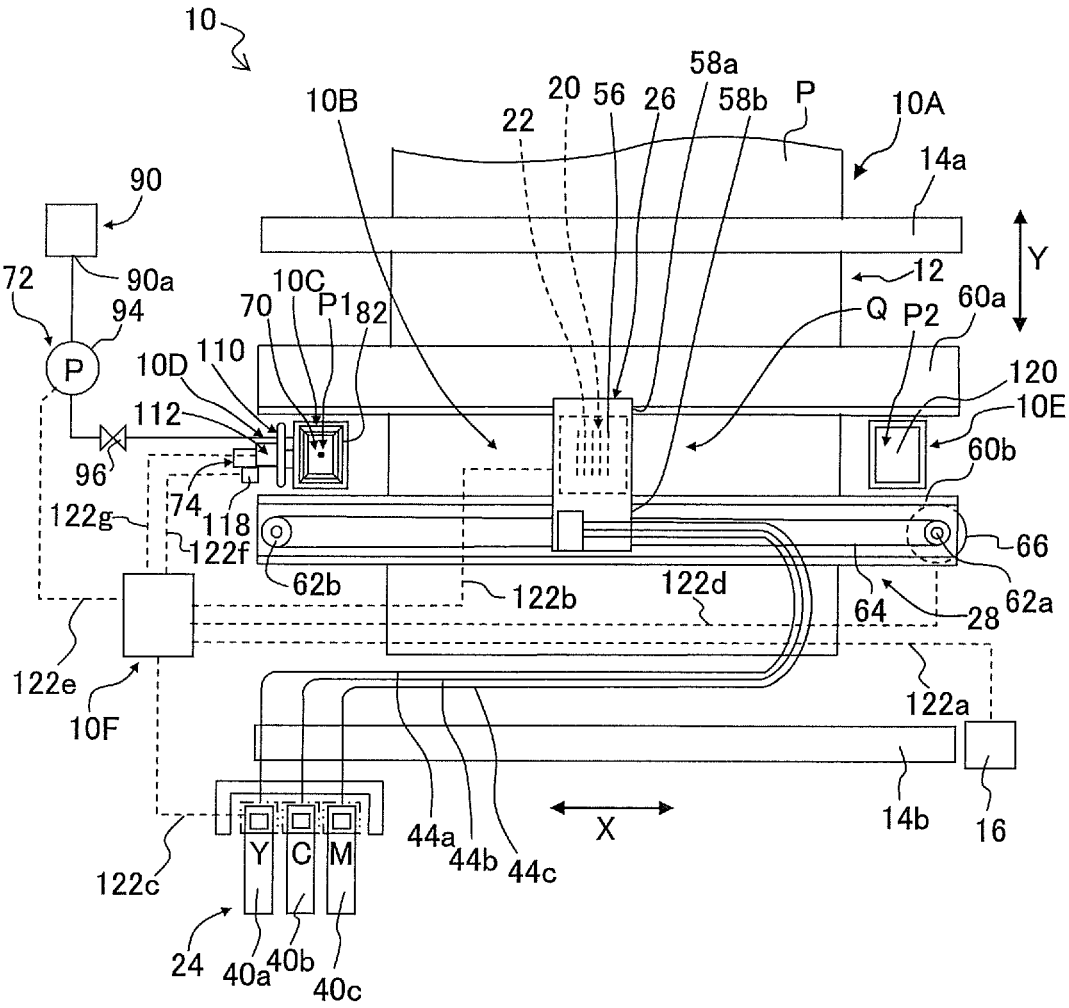
FIG. 1 is a plane view showing the structure of an ink jetting apparatus according to a first embodiment.

As shown in FIG. 1, an ink jetting apparatus 10 according to a first embodiment includes: a paper transporting unit 10A transporting a paper P as a "jetting target" to a printing zone Q; a printing unit 10B printing an image to the paper P transported to the printing zone Q; a purge unit 10C performing a "purge operation"; a wiping unit 10D performing a "wiping operation", a flushing unit 10E performing a "color mixture preventive flushing operation" as a "first flushing operation"; and a control unit 10F controlling these parts. Hereinafter, their structures will be concretely explained.

As shown in FIG. 1, the paper transport unit 10A includes: a transport route 12 guiding the paper P to the printing area Q; an upstream transport roller 14*a* disposed at a position, in the transport route 12, on an upstream of the printing zone Q; a downstream transport roller 14*b* disposed at a position, in the transport route 12, on a downstream of the printing area Q; and a driving motor 16 rotating the transport rollers 14*a*, 14*b*. When the paper P is transported to the printing area Q by the transport rollers 14*a*, 14*b* rotated by the driving motor 16, the paper P is located under the printing unit 10B, enabling the printing to the paper P. Note that in the following explanation, a transporting direction of the paper P will be referred to as a "subsidiary scanning direction Y", and a direction perpendicular to the subsidiary scanning direction Y will be referred to as a "main scanning direction X". Further, in later explanation, "height" of an ink cartridge refers to a length in a vertical direction. In this embodiment, the vertical direction is a direction perpendicular both to the main scanning direction X and the subsidiary scanning direction Y.

As shown in FIG. 1, the printing unit 10B has an ink-jet head 20, an ink supply section 24 supplying inks to the ink-jet head 20, a carriage 26 on which the ink-jet head 20 is mounted, and a scanning section 28 reciprocating the carriage 26.

Figure 2:
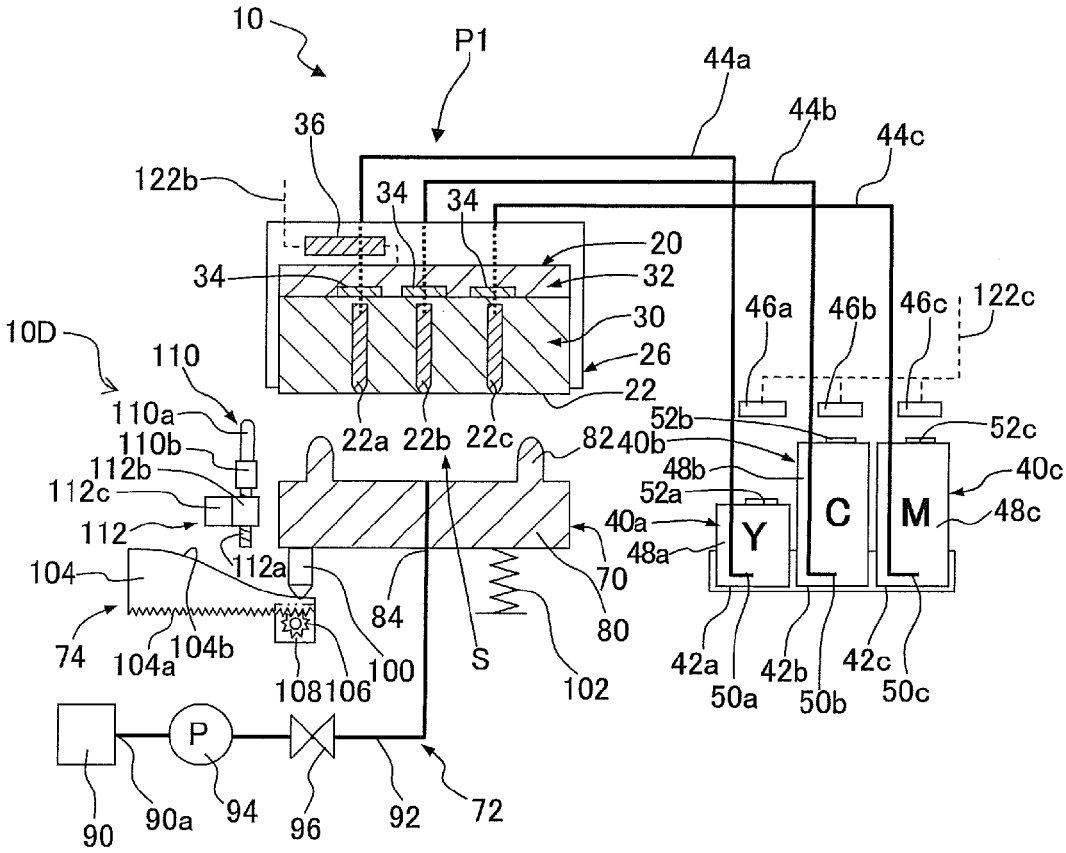
FIG. 2 is a cross-sectional view showing the structure of the ink jetting apparatus according to the first embodiment.

As shown in FIG. 2, the ink-jet head 20 has: a channel unit 30 having a nozzle surface 22 on which nozzles 22*a*, nozzles 22*b*, and nozzles 22*c* are formed; and a driving unit 32 joined to the channel unit 30. The channel unit 30 has a plurality of manifolds (not shown) storing different color inks respectively, and each of the nozzles 22*a*, 22*b*, and 22*c* communicate with one of the manifolds. That is, the nozzles 22*a* communicate with the manifold storing a yellow (Y) ink, the nozzles 22*b* communicate with the manifold storing a cyan (C) ink, and the nozzles 22*c* communicate with the manifold storing a magenta (M) ink. It should be noted that "the number of colors" and "the kinds of colors" of the inks are not particularly limited. The number of colors may be two, or four or more, and a black (BK) ink may be used. Further, the nozzles 22*a* communicating with the manifold storing the yellow (Y) ink may be formed as one nozzle, and in this case, the manifold may be omitted. The same applies to the nozzles 22*b* and 22*c*. Note that, in this embodiment, the nozzles 22*a* are arranged in a row along the subsidiary scanning direction Y to form a nozzle row (see FIG. 1). The same applies to the nozzles 22*b*, 22*c*.

The driving unit 32 has a plurality of driving sections 34 corresponding individually to the nozzles 22*a*, 22*b*, and 22*c* respectively. The control unit 10F (FIG. 1) is electrically connected to the driving unit 32 via a driver IC 36. When a control signal is given from the control unit 10F to the driver IC 36, a driving signal is given from the driver IC 36 to each of the driving sections 34, and the ink is selectively jetted from the nozzles 22*a*, 22*b*, or 22*c* corresponding to the relevant driving section 34. Here, each of the driving sections 34 is formed by a piezoelectric actuator having a piezoelectric layer made of a piezoelectric material such as PZT and a pair of electrodes arranged to sandwich the piezoelectric layer. However, in the present teaching, the driving sections 34 do not necessarily have to be formed by the piezoelectric actuators. For example, it is also possible to adopt what is called a bubble-jet type driving section having a heater converting the driving signal given from the driver IC 36 to heat.

As shown in FIG. 2, the ink supply section 24 has: three ink cartridges 40*a*, 40*b*, and 40*c* storing the three color inks (yellow (Y), cyan (C), and magenta (M)) respectively; cartridge attaching sections 42*a*, 42*b*, and 42*c* (individual cartridge attaching sections) in which the ink cartridges 40*a*, 40*b*, and 40*c* are detachably attached; three ink tubes 44*a*, 44*b*, and 44*c* through which the inks in the ink cartridges 40*a*, 40*b*, and 40*c* are supplied to the corresponding nozzles 22*a*, 22*b*, and 22*c* of the channel unit 30 (FIG. 2) respectively; and size detecting sections 46*a*, 46*b*, and 46*c* detecting sizes of the ink cartridges 40*a*, 40*b*, and 40*c*. Note that in the present application, the sizes of the ink cartridges refer to height sizes of the ink cartridges.

The ink cartridges 40*a*, 40*b*, and 40*c* have substantially rectangular parallelepiped container bodies (substantially cuboid-shaped container bodies) 48*a*, 48*b*, 48*c* respectively, and on lower side surfaces of the container bodies 48*a*, 48*b*, and 44*c*, ink outlets 50*a*, 50*b*, 50*c* communicating with the ink tubes 44*a*, 44*b*, and 44*c* respectively are formed. Further, indicators (markers) 52*a*, 52*b*, and 52*c*, which are printed, pasted, or the like, such as barcodes containing "size-related information" are affixed to upper surfaces of the container bodies 48*a*, 48*b*, and 48*c*. Above the ink cartridges 40*a*, 40*b*, 40*c*, the size detecting sections 46*a*, 46*b*, and 46*c* such as optical sensors detecting the sizes by reading the "size-related information" from the indicators 52*a*, 52*b*, and 52*c* are disposed.

Here, the "size-related information" contained in the indicators 52*a*, 52*b*, and 52*c* is information indicating to which of "large", "medium", and "small" the sizes of the ink cartridges 40*a*, 40*b*, and 40*c* belong, and is information indirectly indicating to which of "large capacity", "medium capacity", and "small capacity" initial capacities of the ink cartridges 40*a*, 40*b*, and 40*c* belong. Therefore, the size detecting sections 46*a*, 46*b*, and 46*c* are capable of indirectly reading the initial capacities of the ink cartridges 40*a*, 40*b*, and 40*c* by reading their sizes from the indicators 52*a*, 52*b*, and 52*c*.

Incidentally, the size detecting sections 46*a*, 46*b*, and 46*c* may be structured to detect the "size-related information" by mechanically detecting projections which are formed at different positions depending on the sizes, or may be structured to detect the "size-related information" by optically or mechanically detecting the outer shapes or contours of the ink cartridges 40*a*, 40*b*, and 40*c*.

The ink cartridges 40*a*, 40*b*, and 40*c* are attached in the cartridge attaching sections 42*a*, 42*b*, and 42*c* respectively. Here, in the cartridge attaching section 42*a* corresponding to the yellow ink, three kinds of ink cartridges 40*a* with different sizes ("large", "medium", and "small") are attachable. Similarly, in the cartridge attaching sections 42*b*, 42*c*, three kinds of the ink cartridges 40*b* or 40*c* with different sizes are attachable. The cartridge attaching sections 42*a*, 42*b*, and 42*c* are formed so that bottom surfaces of the ink cartridges 40*a*, 40*b*, and 40*c* are located at the same height even when the ink cartridges 40*a*, 40*b*, and 40*c* of any sizes are attached. Further, the cartridge attaching sections 42*a*, 42*b*, and 42*c* are formed so that initial liquid levels inside the ink cartridges 40*a*, 40*b*, and 40*c* are lower than heights of jetting ports of the nozzles 22*a*, 22*b*, and 22*c* even when the ink cartridges 40*a*, 40*b*, and 40*c* of "large" size that is the largest size are attached in the cartridge attaching sections 42*a*, 42*b*, and 42*c*.

It should be noted that the bottom surfaces of the ink cartridges 40*a*, 40*b*, and 40*c* do not necessarily have to be located at the same heights and may be located at different heights. Even when the initial liquid level of the "small" ink cartridge 40*a* as a result becomes equal to or higher than the initial liquid levels of the "large" ink cartridges 40*b*, 40*c*, the liquid levels of the "large" ink cartridges 40*b*, 40*c* will be higher than the liquid level of the "small" ink cartridge 40*a* in due course after the start of the use, because a speed at which the liquid levels of the "large" ink cartridges 40*b*, 40*c* lowers is slower than a speed at which the liquid level of the "small" ink cartridge 40*a* lowers, and therefore, regarding the "large" ink cartridge 40*b*, 40*c*, a degree of the backflow of the inks in the ink-jet head 20 will reduce.

Further, sizes of the bottom surfaces (bottom surface shapes) of the ink cartridges are all equal irrespective of the sizes of the ink cartridges. That is, irrespective of the sizes of the ink cartridges, they are all equal in width and depth. However, the difference of the sizes of the ink cartridges is due to the difference of the heights of the ink cartridges. Concretely, the height of the "medium" ink cartridge is larger by about 20 mm than the height of the "small" ink cartridge, and the height of the "large" ink cartridge is larger by about 20 mm than the height of the "medium" ink cartridge. In the present teaching, it is not essential that the ink cartridges having different sizes have the same bottom surface shape. However, in this embodiment, forming the ink cartridges having different sizes to have the same bottom surface shape makes it possible to attach the ink cartridges having different sizes in the cartridge attaching section without giving any special design to the cartridge attaching section.

Figure 3A:
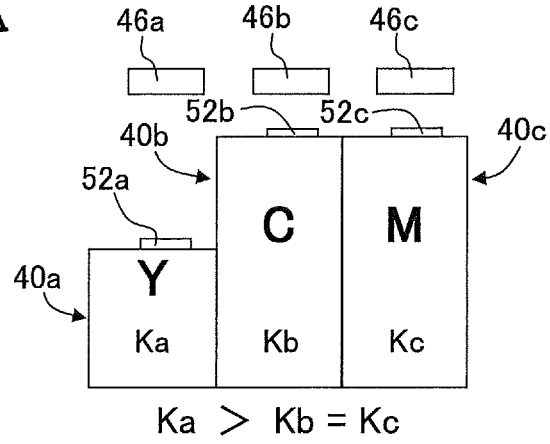
FIGS. 3A, 3B, and 3C are views each showing a correlation between sizes of ink cartridges and amounts of inks jetted idle in a "color mixture preventive flushing operation (that is, a first flushing operation)"
Figure 3B:
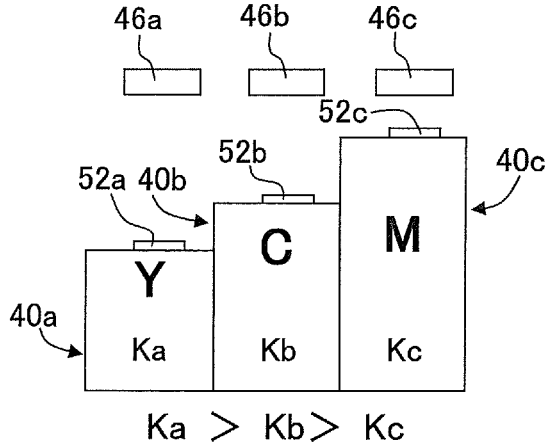
Figure 3C:
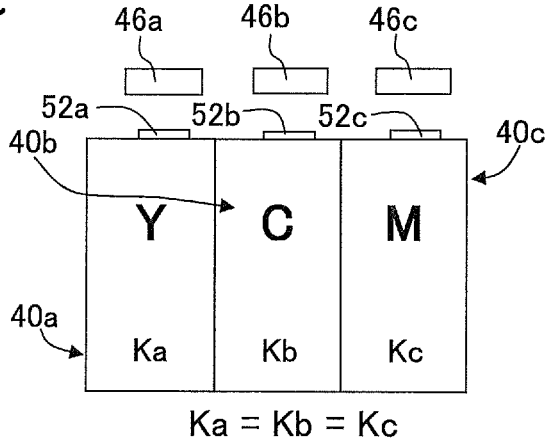

In this embodiment, as shown in FIGS. 2 and 3A, the size of the yellow (Y) ink cartridge 40*a* is "small", the size of the cyan (C) ink cartridge 40*b* is "large", and the size of the magenta (M) ink cartridge 40*c* is "large", but it should be noted that these sizes are changeable as necessary. For example, as shown in FIG. 3B, the sizes of the ink cartridges 40*a*, 40*b*, and 40*c* may be "small", "medium", and "large" respectively, or the sizes of the ink cartridges 40*a*, 40*b*, and 40*c* may all be equal, as shown in FIG. 3C. Further, selectable kinds of the sizes of the ink cartridges 40*a*, 40*b*, and 40*c* such as "extra large" and "extra small" may be added, or on the contrary, the sizes of the ink cartridges may be of two kinds.

As shown in FIG. 1, the carriage 26 is a substantially rectangular parallelepiped member which is elongated in the subsidiary scanning direction Y, and has a holder section 56 holding the ink-jet head 20 and sliding sections 58*a*, 58*b* integrally formed with the holder section 56 and attached slidably to guide rails 60*a*, 60*b* (to be described later) respectively.

As shown in FIG. 1, the scanning section 28 reciprocates the ink-jet head 20 with the carriage 26 in the main scanning direction X, and has the two long plate-shaped guide rails 60*a*, 60*b* guiding the carriage 26, a driving pulley 62*a* provided at one end of the guide rail 60*b*, a driven pulley 62*b* provided at the other end of the guide rail 60*b*, an annular driving belt 64 suspended between the driving pulley 62*a* and the driven pulley 62*b*, and a driving motor 66 rotating the driving pulley 62*a*, and the carriage 26 being fixed to the driving belt 64. In this embodiment, a "home position P1" where the purge unit 10C is disposed is located on one side of the transport route 12 in the main scanning direction X, and a "flushing position P2" where the flushing unit 10E is disposed is located on the other side of the transport route 12. The scanning section 28 is structured so that the ink-jet head 20 is capable of reciprocating at least between the "home position P1" and the "flushing position P2".

Incidentally, the printing unit 10B, though being a "serial type" in this embodiment, may be a "line type" that prints while moving the paper P relatively to a fixed ink-jet head.

As shown in FIG. 2, the purge unit 10C includes: a nozzle cap 70 covering the nozzle surface 22 of the ink-jet head 20 when the carriage 26 is stopped; a sucking section 72 sucking air and waste ink from an inner space (hereinafter, referred to as a "cap space") S of the nozzle cap 70; a cap operating section 74 attaching the nozzle cap 70 on the nozzle surface 22 or detaching the nozzle cap 70 from the nozzle surface 22; and the control unit 10F as a "purge control unit".

The nozzle cap 70 has: a cap body 80 having a substantially rectangular plate shape in a plan view and located to face the nozzle surface 22 of the ink-jet head 20 when the carriage 26 is stopped; and a lip 82 in an annular shape rising from an upper surface of an outer peripheral portion of the cap body 80. At a center portion of the cap body 80, a discharge hole 84 is formed.

The sucking section 72 has: a waste ink tank 90; a waste ink channel 92 through which an inlet port 90*a* of the waste ink tank 90 is communicated with the discharge hole 84; a suction pump 94 provided in the middle of the waste ink channel 92; and a shut-off valve 96 provided at a position, in the middle of the waste ink channel 92, on an upstream side of the suction pump 94. Therefore, when the shut-off valve 96 is opened and the suction pump 94 is driven, the air and waste ink in the cap space S are sucked by the suction pump 94 to be discharged from the discharge hole 84 and is discharged to the waste ink tank 90 through the waste ink channel 92.

The cap operating section 74 switches between a capping state and an uncapping state by moving up/down the nozzle cap 70, and includes: an operation rod 100 formed to project down from a bottom surface of the nozzle cap 70; a coil spring 102 biasing the nozzle cap 70 down; a substantially triangular cam 104 having a rack gear 104*a* on its bottom; a pinion gear 106 engaged with the rack gear 104*a*; and a driving motor 108 rotating the pinion gear 106. Therefore, when the pinion gear 106 is rotated by the driving motor 108, the cam 104 is moved in a direction perpendicular to an up-down direction to move up or down the operation rod 100 and the nozzle cap 70 along an inclined surface 104*b* of the cam 104.

The control unit 10F as the "purge control unit" operates the cap operating section 74 so that the nozzle cap 70 is attached onto the nozzle surface 22, and thereafter operates the sucking section 72. The "purge operation" in a series maintenance operations will be explained in detail later.

As shown in FIG. 2, the wiping unit 10D includes: a wipe blade 110 wiping off the ink adhering to the nozzle surface 22 of the ink-jet head 20 by coming into contact with the nozzle surface 22; a blade operating section 112 bringing the wipe blade 110 into contact with the nozzle surface 22 or separating the wipe blade 110 from the nozzle surface 22; and the control unit 10F as a "wiping control unit".

The wipe blade 110 has a plate-shaped blade body 110*a* made of an elastic material such as rubber and a blade holder 110*b* attached to a lower portion of the blade body 110, and the blade operating section 112 has a male screw member 112*a* attached to the blade holder 110*b*, a female screw member 112*b* screwed to the male screw member 112*a*, and a driving motor 112*c* rotating the female screw member 112*b*. When the female screw member 112*b* is rotated by the driving motor 112*c*, the male screw member 112*a* and the wipe blade 110 move up or down according to a direction of the rotation.

The control unit 10F as the "wiping control unit" operates the blade operating section 112 so that the wipe blade 110 wipes off the ink adhering to the nozzle surface 22. The "wiping operation" in a series of the maintenance operations will be explained in detail later.

As shown in FIG. 1, the flushing unit 10E performs: a "color mixture preventive flushing operation" as a "first flushing operation" in which the inks flowing back into the ink-jet head 20 are forcibly jetted from the nozzles 22*a*, 22*b*, and 22*c* for the purpose of "color mixture prevention"; and a "drying preventive flushing operation" as a "second flushing operation" in which the inks in the ink-jet head 20 are forcibly jetted from the nozzles 22*a*, 22*b*, and 22*c* for the purpose of "drying prevention". The flushing unit 10E includes: the driving sections 34 (FIG. 2); a flushing foam 120 disposed opposite the nozzle cap 70 across the transport route 12 and receiving and sucking the inks forcibly jetted from the nozzles 22*a*, 22*b*, and 22*c*; and the control unit 10F as a "flushing control unit".

In order to cause the execution of the "color mixture preventive flushing operation (first flushing operation)", the control unit 10F as the "flushing control unit" operates the driving sections 34 so that an amount of the liquid (ink) forcibly jetted (that is, an amount of the ink jetted during the idle jetting) from nozzles communicating with a first liquid cartridge becomes smaller than an amount of the liquid (ink) forcibly jetted (that is, an amount ink jetted during the idle jetting) from nozzles communicating with a second liquid cartridge when the size of the first liquid cartridge detected by a "first size detecting section" which is one of the size detecting sections 46*a*, 46*b*, and 46*c* is larger than the size of the second liquid cartridge detected by a "second size detecting section" which is another one of the size detecting sections 46*a*, 46*b*, and 46*c*.

As shown in FIG. 3A, in this embodiment, the size detecting sections 46*a*, 46*b*, and 46*c* detect "small", "large", and "large" respectively. At this time, the control unit 10F (that is, the flushing control unit) operates the driving sections 34 so that amounts Kb and Kc of the inks forcibly jetted from the nozzles 22*b* and 22*c* become smaller than an amount Ka of the ink forcibly jetted from the nozzles 22*a*.

Further, as shown in FIG. 3B, when the size detecting sections 46*a*, 46*b*, and 46*c* detect "small", "medium", and "large" respectively, the control unit 10F operates the driving sections 34 so that amounts Kc, Kb, and Ka of the inks forcibly jetted from the nozzles 22*c*, 22*b*, and 22*a* are the smallest, the second smallest, and the third smallest respectively. Then, as shown in FIG. 3C, when all the size detecting sections 46*a*, 46*b*, and 46*c* detect "large", the control unit 10F operates the driving sections 34 so that amounts Ka, Kb, and Kc of the inks forcibly jetted from the nozzles 22*a*, 22*b*, and 22*c* become equal.

Further, when the size detecting sections 46*a*, 46*b*, and 46*c* all detect "medium", though this case is not shown; the control unit 10F operates the driving sections 34 so that amounts Ka, Kb, and Kc of the inks forcibly jetted from the nozzles 22*a*, 22*b*, and 22*c* become equal but larger than those when they all detect "large". Further, when the size detecting sections 46*a*, 46*b*, and 46*c* all detect "small", the control unit 10F operates the driving sections 34 so that amounts Ka, Kb, and Kc all become equal but larger than those when they all detect "medium".

Concretely, for example, when a ratio of the height (a height ratio) of the "small"-sized ink cartridge and the "large"-sized ink cartridge is 1:2, the driving sections are driven so that a ratio of an amount of the ink forcibly jetted from the nozzles corresponding to the "small"-sized ink cartridge and an amount of the ink forcibly jetted from the nozzles corresponding to the "large"-sized ink cartridge becomes 2:1.

On the other hand, in order to cause the execution of the "drying preventive flushing operation (the second flushing operation)", the control unit 10F as the "flushing control unit" operates the driving sections 34 so that amounts of the inks jetted from all the nozzles 22*a*, 22*b*, and 22*c* become equal irrespective of the detection results of the size detecting sections 46*a*, 46*b*, and 46*c*, whereby the inks whose viscosities have increased due to evaporation are discharged simultaneously. It should be noted that amounts of the inks jetted in this operation do not necessarily have to be equal but may be appropriately changed according to the viscosities or the like of the inks. Here, in the drying preventive flushing operation, it is only necessary that the inks with the increased viscosities near surfaces of openings of the nozzles 22*a*, 22*b*, and 22*c* are jetted. On the other hand, in the aforesaid color mixture preventive flushing operation, all the mixed color inks mixed in the nozzles 22*a*, 22*b*, and 22*c* have to be jetted. Since the mixed color ink remaining in the nozzles, if any, greatly affects printing quality, it is necessary to discharge the ink in the color mixture preventive flushing operation to such an extent that the mixed color ink is completely discharged. Therefore, in the color mixture preventive flushing operation, a far larger amount of the ink is discharged than in the drying preventive flushing operation. Generally, in the color mixture preventive flushing operation, an amount of the ink discharged is ten times or more (for example, 50 to 60 times) as much as an amount of the ink discharged in the drying preventive flushing operation. Thus, since the drying preventive flushing operation and the color mixture preventive flushing operation have different purposes and necessary amounts of the inks jetted in these operations greatly differ, these two flushing operations are discriminated from each other.

As shown in FIG. 1, the control unit 10F controls targets to be driven such as the driving motor 16 of the "paper transport unit 10A", the driving sections 34 (FIG. 2), the size detecting sections 46*a*, 46*b*, 46*c*, and the driving motor 66 of the "printing unit 10B", the suction pump 94 and the driving motor 108 of the "purge unit 10C", the driving motor 112*c* of the "wiping unit 10D", and the driving sections 34 of the "flushing unit 10E". The control unit 10F has a central processing unit (CPU) executing various kinds of arithmetic processing, storage devices (RAM, ROM) storing various kinds of programs or data, and so on. Note that the CPU and the storage devices are not shown in the diagrams. The aforesaid targets to be driven are electrically connected to the central processing unit (CPU), the storage devices (RAM, ROM), and so on via electric wirings 122*a* to 122*g*.

As shown in FIG. 1, when a printing operation of the ink jetting apparatus 10 is started, the paper P is transported to the printing zone Q at a predetermined timing by the rotation of the transport rollers 14*a*, 14*b*. Further, by the rotation of the driving belt 64, the carriage 26 and the ink-jet head 20 are reciprocated in the main scanning direction X. Then, the driving signals are given from the driver IC 36 to the driving sections 34 of the ink-jet head 20, so that the inks are selectively jetted from the nozzles 22*a*, 22*b*, and 22*c* corresponding to the relevant driving sections 34 and an image is printed to the paper P.

Figure 4:
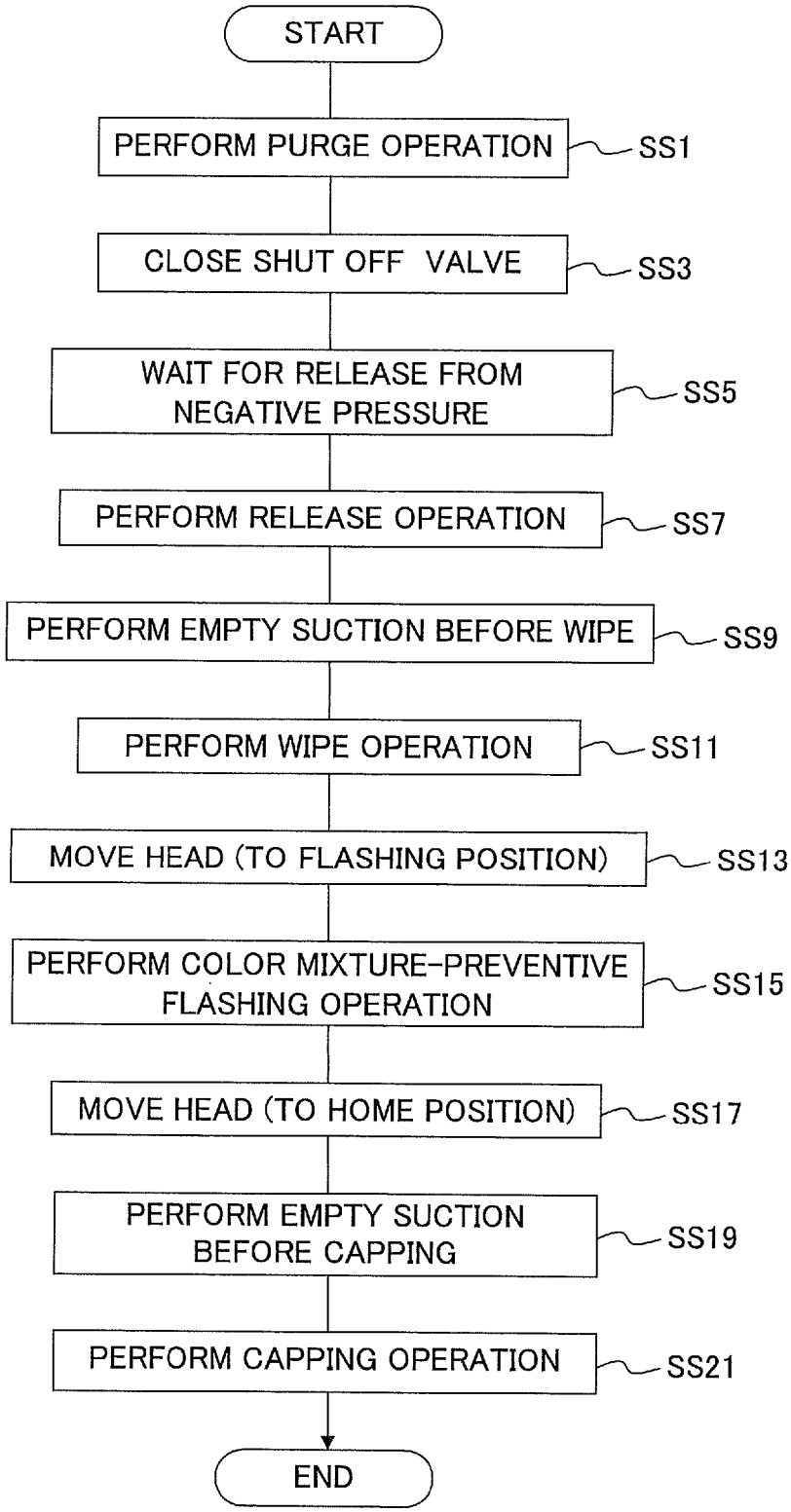
FIG. 4 is flowchart showing a "maintenance process" of the ink jetting apparatus according to the first embodiment.

After the long-term continuous use of the ink jetting apparatus 10, the viscosities of the inks in the ink-jet head 20 increase or bubbles are mixed in the inks inside the ink-jet head 20, which may possibly cause a jetting failure of the inks. Therefore, in this embodiment, the control unit 10F executes a "maintenance process" shown in FIG. 4 periodically or at an arbitrary timing.

Figure 5A:
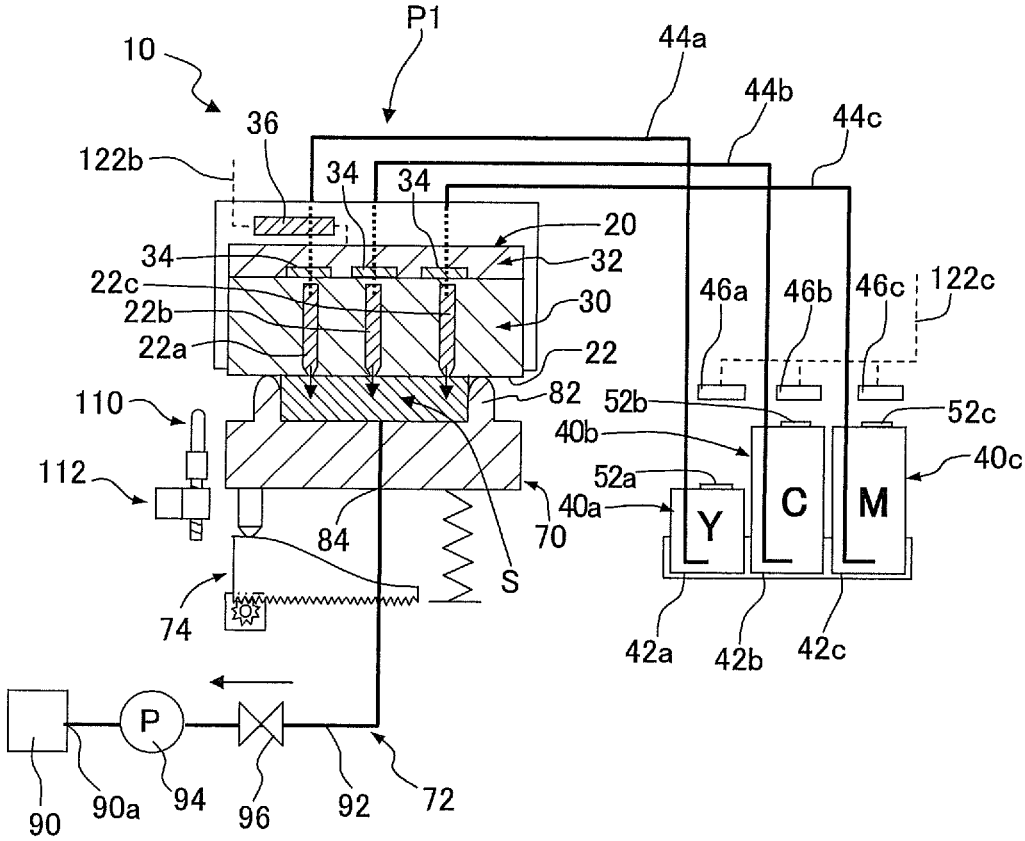
FIG. 5A is a cross-sectional view showing a "purge operation" of the ink jetting apparatus according to the first embodiment.

When the "maintenance process" is started, the "purge operation" is first executed at Step SS1. Specifically, as shown in FIG. 5A, the scanning section 28 first moves the ink-jet head 20 to the "home position P1", and subsequently the cap operating section 74 moves up the nozzle cap 70 to make the lip 82 abut on the nozzle surface 22 (the capping state). Thereafter, the suction pump 94 is driven while the shut-off valve 96 is in an opened state, so that air in the cap space S defined by the nozzle cap 70 and the nozzle surface 22 is sucked. Consequently, a negative pressure is generated inside the cap space S, so that the inks with the increased viscosities and bubbles inside the ink-jet head 20 are attracted by the negative pressure to be discharged from the nozzles 22*a*, 22*b*, and 22*c* into the cap space S. The waste inks discharged into the cap space S are discharged to the waste ink tank 90 via the waste ink channel 92.

Figure 5B:
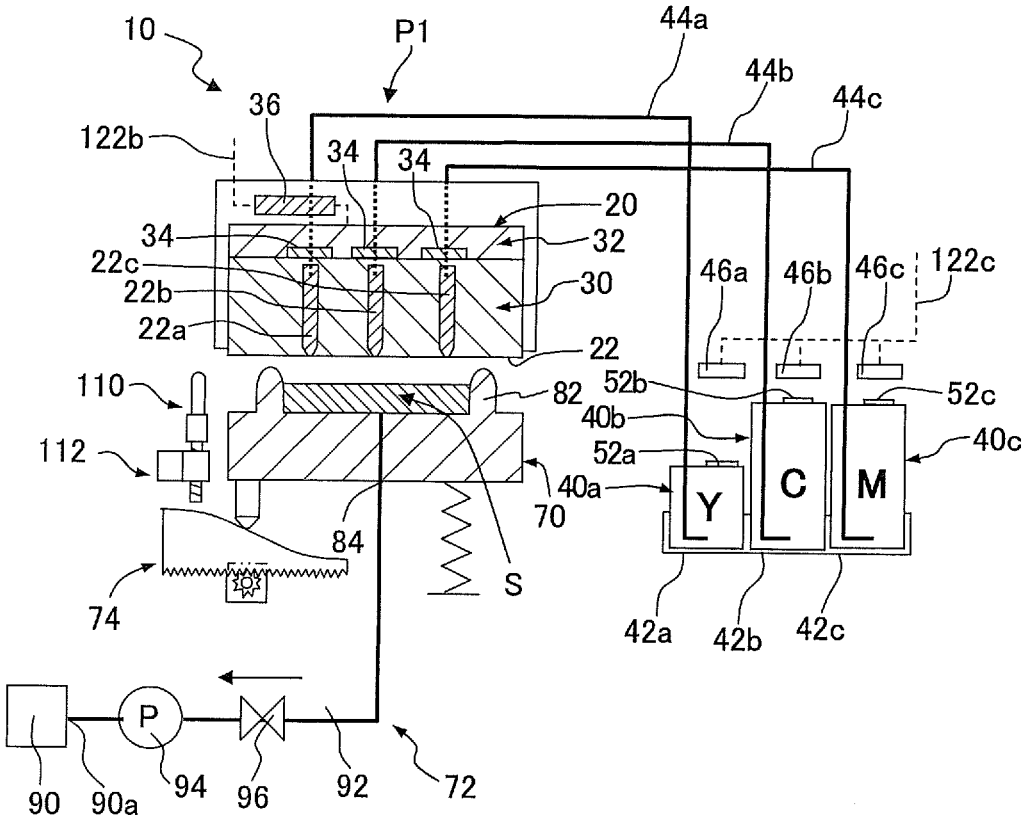
FIG. 5B is a cross-sectional view showing a "release operation" of the ink jetting apparatus according to the first embodiment.

Upon completion of the "purge operation", the shut-off valve 96 is closed at Step SS3, and at Step SS5, the capping state is kept until the negative pressure is released from the cap space S. When a time until the negative pressure is released from the cap space S passes, a "release operation" is executed at Step SS7. Specifically, as shown in FIG. 5B, the cap operating section 74 moves down the nozzle cap 70 to detach or separate the nozzle cap 70 from the nozzle surface 22. Further, at Step SS9, an empty suction or idle suction (that is, pre-wiping idle suction, empty suction before wipe) is executed by the suction pump 94, so that the waste ink remaining in the cap space S is discharged to the waste ink tank 90.

Figure 6A:
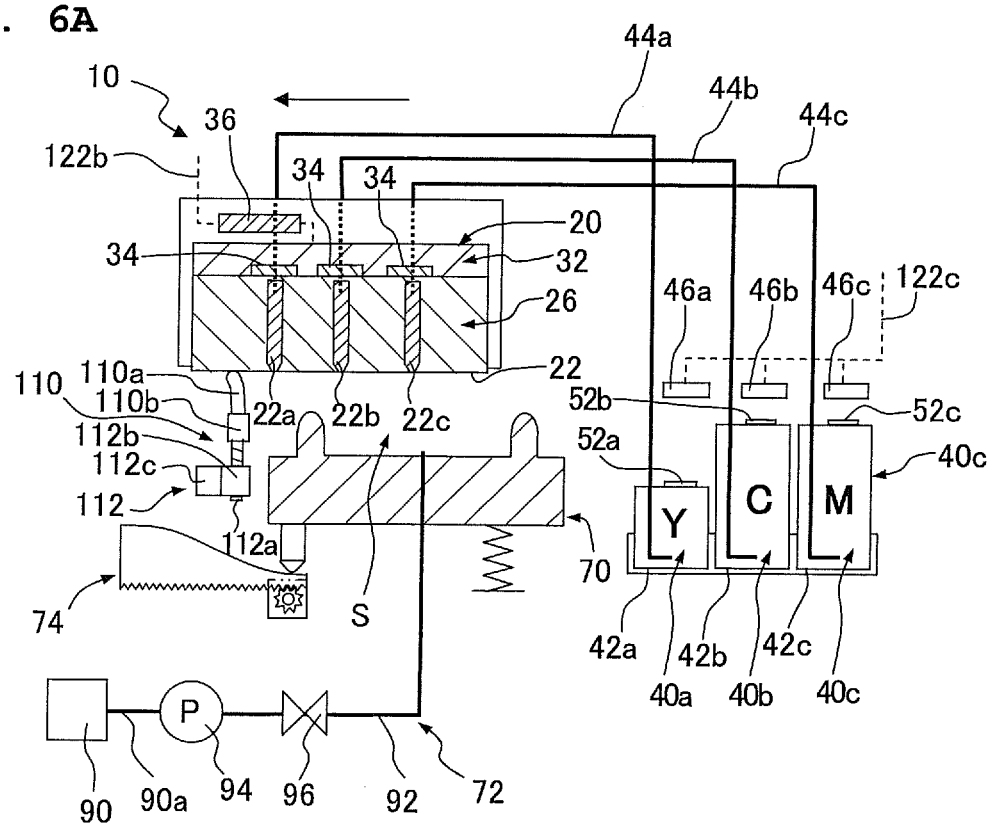
FIG. 6A is a cross-sectional view showing a "wiping operation" of the ink jetting apparatus according to the first embodiment.

Then, at Step SS11, the "wipe operation" is executed. Specifically, as shown in FIG. 6A, the wipe blade 110 is moved up by the blade operating section 112 to abut on the nozzle surface 22, and thereafter, the ink-jet head 20 is moved in the main scanning direction X by the scanning section 28. Consequently, the wipe blade 110 moves relatively to the nozzle surface 22 to wipe off the ink and so on adhering to the nozzle surface 22.

In the processes at Step SS3 to SS9, a pressure inside the cap space S increases from the negative pressure to an atmospheric pressure. On the other hand, the inside of the ink-jet head 20 (inside the nozzles 22*a*, 22*b*, 22*c*) is kept at the negative pressure. Therefore, the waste ink in the cap space S is liable to flow back toward the inside of the nozzles 22*a*, 22*b*, and 22*c*. Further, in the process at Step SS11 (wipe operation), the ink adhering to the nozzle surface 22 is liable to be pushed into the nozzles 22*a*, 22*b*, and 22*c* by the wipe blade 110. Therefore, at the next Step SS13, the ink-jet head 20 is moved to the "flushing position P2" by the scanning section 20, and at subsequent Step SS15, the "color mixture preventive flushing operation (that is, the first flushing operation)" is executed.

Figure 6B:
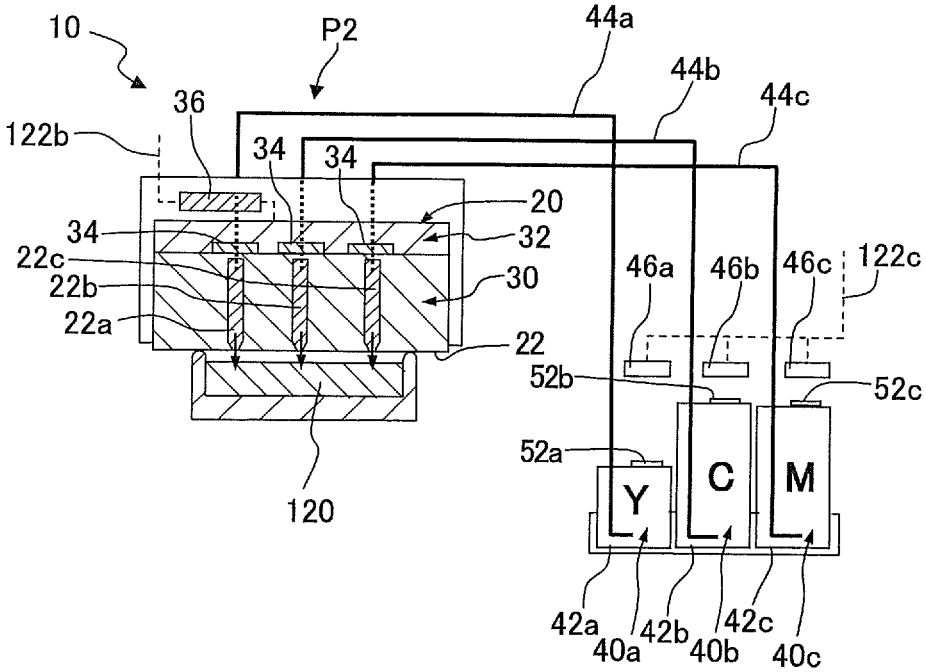
FIG. 6B is a cross-sectional view showing the "color mixture preventive flushing operation (that is, the first flushing operation)" of the ink jetting apparatus according to the first embodiment.

When the "color mixture preventive flushing operation" is started, as shown in FIG. 6B, the sizes of the ink cartridges 40*a*, 40*b*, and 40*c* are first detected by the size detecting sections 46*a*, 46*b*, and 46*c*, and the driving sections 34 are thereafter driven, so that predetermined amounts of the inks according to the sizes are forcibly jetted from the nozzles 22*a*, 22*b*, and 22*c* to the flushing foam 120. That is, the operations of the driving sections 34 are controlled so that the larger the size of the ink cartridge is, the less the amount of ink jetted during the idle jetting is. Note that the sizes of the ink cartridges 40*a*, 40*b*, and 40*c* may be detected at a point in time when they are attached in the cartridge attaching sections 42*a*, 42*b*, and 42*c*. Further, amounts of the inks jetted in the "color mixture preventive flushing operation" may be adjusted by a change in the number of times of the idle jetting, or may be adjusted by a change in an amount of the inks jetted during one cycle of the idle jetting (during a single idle jetting).

Upon completion of the "color mixture preventive flushing operation (that is, the first flushing operation)", the ink-jet head 20 is moved to the "home position P1" at Step SS17, an empty suction (that is, empty suction before capping, pre-capping idle suction) is performed by the suction pump 94 at Step SS19, and the "capping operation" is executed at Step SS21. That is, the nozzle cap 70 is moved up by the cap operating part 74, so that the lip 82 abuts on the nozzle surface 22.

Further, the "drying preventive flushing operation (that is, the second flushing operation)" is executed periodically or at an arbitrary timing by the control unit 10F as the "flushing control unit", so that the inks whose viscosities have increased due to the evaporation are discharged from all the nozzles 22*a*, 22*b*, and 22*c*, simultaneously.

In the above-described embodiment, amounts of the inks jetted during the idle jetting in the color mixture preventive flushing operation are adjusted according to the sizes of the ink cartridges. Here, there can be a case where the liquid level of the large-capacity ink cartridge becomes lower than the liquid level of the small-capacity ink cartridge while the ink jetting apparatus is used. However, such reversing of the liquid level of the large-capacity ink cartridge and the liquid level of the small-capacity ink cartridge during the use does not occur frequently. Further, it can be generally said that a liquid level difference occurring at this time is smaller than a liquid level difference occurring when new large-capacity ink cartridge and small-capacity ink cartridge are attached. Therefore, it is very meaningful to reduce excessive idle jetting by adjusting amounts of the inks jetted during the idle jetting in the color mixture preventive flushing operation according to the sizes of the ink cartridges as is done in this embodiment.

In the above-described embodiment, the three ink cartridges storing the three yellow (Y), cyan (C), and magenta (M) color inks are provided in the ink jetting apparatus. However, the present teaching is not limited to this, and for example, an ink cartridge storing a black ink may be further provided. In the case where the ink cartridges for the Y, C, M color inks are used as in this embodiment, even when the numbers of the nozzles 22*a*, 22*b*, 22*c* jetting the respective color inks are equal and the viscosities of the inks are substantially equal, it is also possible to reduce extra idle jetting by adjusting amounts of the inks jetted during the idle jetting in the color mixture preventive flushing operation according to the sizes of the ink cartridges as is done in this embodiment.

In the above-described embodiment, the cartridge attaching sections are structured to allow the attaching of ink cartridges with a plurality of sizes, and the size detecting sections detect which sizes the ink cartridges actually attached in the respective cartridge attaching sections have. However, the present teaching is not limited to this, and for example, the size of the ink cartridge attached in each of the cartridge attaching sections may be decided in advance. The present teaching is applicable to the above case as well if the ink cartridges attached in the cartridge attaching sections have different sizes. For example, the present teaching is applicable to an ink-jet printer structured such that only a large-capacity ink cartridge can be attached for the black ink whose consumption amount is large, and only ink cartridges with a normal capacity whose initial capacities are smaller than that for the black ink can be attached for the color inks whose consumption amount is relatively small. When the sizes of the ink cartridges attached are thus fixedly decided, the size detecting sections are not necessarily required.

The "liquid jetting apparatus" according to the above-described embodiment is an "ink jetting apparatus jetting the inks as "liquid" to the paper, but it should be noted that the present teaching is not limited to this. For example, the present teaching is also applicable to other "liquid jetting apparatuses" such as, for example, a "coloring liquid jetting apparatus" jetting a coloring liquid to a filter substrate and the like. When the present teaching is applied to the "coloring liquid jetting apparatus", "ink" mentioned in the above explanation is read as "coloring liquid".

What is claimed is:

1. A liquid jetting apparatus which jets a first liquid stored in a first liquid cartridge and a second liquid stored in a second liquid cartridge, comprising:

a first cartridge attaching section configured to attach the first liquid cartridge;

a second cartridge attaching section configured to attach the second liquid cartridge;

a liquid jetting head in which a plurality of nozzles are formed, the nozzles including a plurality of first nozzles and a plurality of second nozzles which communicate with the first and second liquid cartridges respectively under a condition that the first and second liquid cartridges are attached to the first and second cartridge attaching sections, the liquid jetting head having a plurality of driving sections provided corresponding to the nozzles to cause each of the nozzles to jet one of the first and second liquids; and a flushing control unit which controls the driving sections to perform a first flushing operation in which an amount of the first liquid forcibly jetted from the first nozzles is made smaller than an amount of the second liquid forcibly jetted from the second nozzles under a condition that a height of the first cartridge attached to the first cartridge attaching section is greater than a height of the second cartridge attached to the second cartridge attaching section.

2. The liquid jetting apparatus according to claim 1, further comprising:

the first and second liquid cartridges; and first and second size detecting sections detecting sizes in height of the first and second liquid cartridges attached to the first and second cartridge attaching sections, wherein under a condition that the size in height of the first cartridge detected by the first size detecting section is greater than the size in height of the second cartridge detected by the second size detecting section, the flushing control unit controls the driving sections, as the first flushing operation, to make the amount of the first liquid forcibly jetted from the first nozzles smaller than the amount of the second liquid forcibly jetted from the second nozzles.

3. The liquid jetting apparatus according to claim 1, wherein the liquid jetting head has a nozzle surface on which the nozzles are formed, the liquid jetting apparatus further comprising:

a nozzle cap covering the nozzle surface of the liquid jetting head;

a cap operating section attaching the nozzle cap onto the nozzle surface and separating the nozzle cap from the nozzle surface;

a sucking section communicating with the nozzle cap and sucking air in a space defined by the nozzle cap and the nozzle surface; and a purge control unit which controls the cap operating section and the sucking section to perform a purge operation of discharging the inks in the nozzles, wherein the purge control unit controls the cap operating section to attach the nozzle cap onto the nozzle surface, then controls the sucking section to generate a negative pressure in the space, and thereafter controls the cap operating section to separate the nozzle cap from the nozzle surface.

4. The liquid jetting apparatus according to claim 2, wherein the liquid jetting head has a nozzle surface on which the nozzles are formed, the liquid jetting apparatus further comprising:

a wipe blade which comes into contact with the nozzle surface of the liquid jetting head to wipe off the liquid adhering to the nozzle surface;

a blade operating section bringing the wipe blade into contact with the nozzle surface and moving the wipe blade relative to the nozzle surface while keeping the wipe blade in contact with the nozzle surface; and a wiping control unit which controls the blade operating section such that the blade operating section makes the wipe blade perform a wiping operation of wiping the nozzle surface.

5. The liquid jetting apparatus according to claim 3, wherein the liquid jetting head has a nozzle surface on which the nozzles are formed, the liquid jetting apparatus further comprising:

a wipe blade which comes into contact with the nozzle surface of the liquid jetting head to wipe off the liquid adhering to the nozzle surface;

a blade operating section bringing the wipe blade into contact with the nozzle surface and moving the wipe blade relative to the nozzle surface while keeping the wipe blade in contact with the nozzle surface; and a wiping control unit which controls the blade operating section such that the blade operating section makes the wipe blade perform a wiping operation of wiping the nozzle surface.

6. The liquid jetting apparatus according to claim 5, wherein the flushing control unit is configured such that: the flushing control unit controls the driving section to perform the first flushing operation; after the cap operating section is controlled by the purge control unit and the sucking section to perform the purge operation; and then the blade operating section is controlled by the wiping control section to perform the wiping operation.

7. The liquid jetting apparatus according to claim 1, wherein the flushing control unit controls the driving sections to perform a second flushing operation in which an amount of the first liquid forcibly jetted from the first nozzles is made to be same as an amount of the second liquid forcibly jetted from the second nozzles irrespective of the sizes in height of the first and second cartridges; and the amounts of the first and second liquids jetted in the second flushing operation are not more than one tenth of the amounts of the first and second liquids jetted in the first flushing operation.

8. The liquid jetting apparatus according to claim 2, wherein each of the first and second liquid cartridges includes a liquid cartridge with a first height and a liquid cartridge with a second height different from the first height; and a shape of cross section perpendicular to a height direction of the liquid cartridge with the first height is same as a shape of cross section perpendicular to a height direction of the liquid cartridge with the second height.

9. The liquid jetting apparatus according to claim 1, wherein the first and second liquids are inks of two colors selected from cyan, magenta, and yellow;

a number of the first nozzles and a number of the second nozzles are same; and viscosities of the inks of the two colors are substantially same.

10. The liquid jetting apparatus according to claim 3, wherein the first and second cartridge attaching sections have first and second contacting surfaces contacting on bottom surfaces of the first and second liquid cartridges, respectively, under a condition that the first and second liquid cartridges are attached to the first and second liquid cartridge attaching sections;

positions in a height direction of the first and second contacting surfaces are substantially same; and under a condition that the first and second liquid cartridges are attached to the first and second liquid cartridge attaching sections, liquid levels of the first and second liquids in the first and second liquid cartridges respectively are both located at positions lower than the nozzle surface.

11. The liquid jetting apparatus according to claim 1, wherein the flushing control unit controls the driving sections to perform the first flushing operation so that the second liquid entered into the first nozzles is forcibly jetted from the first nozzles along with the first liquid and that the first liquid entered into the second nozzles is forcibly jetted from the second nozzles along with the second liquid.

12. The liquid jetting apparatus according to claim 1, wherein the flushing control unit controls the driving sections to perform a second flushing operation in which an amount of the first liquid forcibly jetted from the first nozzles is made to be same as an amount of the second liquid forcibly jetted from the second nozzles irrespective of the sizes in height of the first and second liquid cartridges, and is configured to control the driving sections to perform the second flushing operation so that thickened first and second liquids are forcibly jetted from the first and second nozzles.

13. A liquid jetting apparatus which jets a first liquid stored in a first liquid cartridge and a second liquid stored in a second liquid cartridge, comprising:

a first cartridge attaching section configured to attach, as the first liquid cartridge, one of a first cartridge and a second cartridge, a size in height of which is smaller than a size in height of the first cartridge;

a second cartridge attaching section configured to attach the second liquid cartridge;

a liquid jetting head in which a plurality of nozzles are formed, the nozzles including a plurality of first nozzles and a plurality of second nozzles which communicate with the first and second liquid cartridges respectively under a condition that the first and second liquid cartridges are attached to the first and second cartridge attaching sections, the liquid jetting head having a plurality of driving sections provided corresponding to the nozzles to cause each of the nozzles to jet one of the first and second liquids; and a flushing control unit which controls the driving sections to perform a first flushing operation in which an amount of the first liquid forcibly jetted from the first nozzles in a case in which the first cartridge is attached to the first cartridge attaching section is smaller than an amount of the first liquid forcibly jetted from the first nozzles in a case in which the second cartridge is attached to the first cartridge attaching section.

14. The liquid jetting apparatus according to claim 13, further comprising:

the first and second liquid cartridges which accommodate the first liquid and the second liquid therein, respectively, and which are communicated with the first nozzles and the second nozzles respectively under the condition that the first and second liquid cartridges are attached to the first and second cartridge attaching sections; and a size detecting section detecting a size in height of the first liquid cartridge attached to the first cartridge attaching section, wherein the flushing control unit controls the driving sections to perform the first flushing operation so that the amount of the first liquid forcibly jetted from the first nozzles in a case in which the flushing control unit judges that the first cartridge is attached to the first cartridge attaching section based on a detection result of the size detecting section is smaller than the amount of the first liquid forcibly jetted from the first nozzle in a case in which the flushing control unit judges that the second cartridge is attached to the first cartridge attaching section based on the detection result of the size detecting section.

* * * * *